US005123859A

United States Patent [19]

Davis et al.

[11] Patent Number: 5,123,859

[45] Date of Patent: Jun. 23, 1992

[54] BACK-TO-BACK STACKABLE CONNECTOR FOR INTERFACE BUS, AND CABLE CLAMPING SYSTEM USABLE THEREWITH

[75] Inventors: Wayne S. Davis, Harrisburg; Earl W. McCleerey, Mechanicsburg, both of Pa.

[73] Assignee: AMP Incorporated, Harrisburg, Pa.

[21] Appl. No.: 750,778

[22] Filed: Aug. 22, 1991

Related U.S. Application Data

[63] Continuation of Ser. No. 333,071, Mar. 31, 1989, abandoned.

[51] Int. Cl.[5] ..... H01R 4/24

[52] U.S. Cl. ..... 439/405; 439/654; 439/465

[58] Field of Search ..... 439/367, 368, 465, 389–408, 439/417–419, 696, 701, 685, 695, 638, 650, 654, 655

[56] References Cited

U.S. PATENT DOCUMENTS

| | | | |
|---|---|---|---|
| 3,705,378 | 12/1972 | Elkins | 439/638 |
| 3,963,300 | 10/1976 | Patton et al. | 339/156 R |
| 4,083,615 | 4/1978 | Volinskie | 439/405 |
| 4,349,239 | 9/1982 | Roberts et al. | 439/405 |
| 4,392,701 | 7/1983 | Weidler | 439/638 |
| 4,398,780 | 8/1983 | Novotny et al. . | |
| 4,431,249 | 2/1984 | Frantz et al. . | |
| 4,533,200 | 8/1985 | Wilson | 339/99 R |
| 4,592,614 | 6/1986 | Myers, Jr. . | |
| 4,671,601 | 6/1987 | Lomecka | 439/404 |
| 4,701,139 | 10/1987 | Good et al. . | |
| 4,722,698 | 2/1988 | Modschiedler . | |
| 4,728,163 | 3/1988 | Kittinger et al. . | |
| 4,781,615 | 11/1988 | Davis et al. . | |
| 4,818,239 | 4/1989 | Erk . | |

FOREIGN PATENT DOCUMENTS 0214660 3/1987 European Pat. Off. .

OTHER PUBLICATIONS

European Search Report.
Annex to European Search Report.
AMP Catalog 73-152, pp. 59-65, cover page and p. 2, streamlined Jul. 1988.

*Primary Examiner*—David L. Pirlot
*Attorney, Agent, or Firm*—David L. Smith

[57] ABSTRACT

A stackable connector (20) formed by positioning connector housings (22,24) back-to-back and securing them together with terminating covers (26,28). Opposing terminating covers (26,28) have leg means (86,88,90,92) that complement leg means on the other terminating cover to substantially fill apertures (52). Either a short segment of cable or conductors of a cable are terminated on corresponding ones of contacts in the two housings (22,24). The terminating covers (26,28) are secured to housings (22,24) in a pretermination position in which corners (98,100) of leg means (86,88,90,92) engage side walls (126) of apertures (52) in a first interference fit. As termination of the conductors is completed, leg means (86,88,90,92) of terminating cover (86) enter apertures (104,106,108,110) on terminating cover (28) and engage a protrusion (112,114,116,118) in a second interference fit. The second interference fit is between a protrusion (112,114,116,118) and an area of leg means (86,88,90,92) on terminating cover (26) not previously deformed by the first interference fit.

29 Claims, 5 Drawing Sheets

136
136
134
156
148
144
152
130
142
60
154
132
130
150
146
20
138
150
140
156
158
132
158
154

BACK-TO-BACK STACKABLE CONNECTOR FOR INTERFACE BUS, AND CABLE CLAMPING SYSTEM USABLE THEREWITH

This application is a continuation of application Ser. No. 07/333,071 filed Mar. 31, 1989, now abandoned.

BACKGROUND OF THE INVENTION

This invention relates to electrical connectors and, in particular, to stackable connectors that may be used to provide both a male and female connector terminated to an end of a cable or a pair of identical, either male or female, connectors terminated in back-to-back orientation to provide a gender changer connector.

U.S. Pat. Nos. 4,431,249, 4,592,614 and 4,701,139 disclose connectors that are known variously as gender changer, half tap, stackable or male/female connectors.

SUMMARY OF THE INVENTION

In accordance with the present invention, a pair of housing members are provided which can be positioned in back-to-back orientation. Each housing member has a mating face, an opposed rear face and a plurality of contact receiving passages extending therebetween, with contacts secured therein. The contacts define an axis and have a mating portion extending proximate the mating face, a terminating portion extending beyond the rear face, thence normal to the axis of the contacts. A terminal support block extends from the rear face of each housing member and has at least one terminal support block aperture extending therethrough normal to the axis of said contacts and defining aperture walls. A first terminating cover has extending therefrom spaced first and second leg means. The first and second leg means have respective first and second aperture means adjacent thereto, defining respectively first and second wall means. The first leg means are adapted to be received in the terminal support block aperture of the first housing member at a pretermination position in an interference fit between a first portion of the first leg means and a first portion of the aperture wall of the first housing member terminal support block aperture The second leg means are adapted to be received in the terminal support block aperture of the second housing member at a pretermination position in an interference fit between a first portion of the second leg means and a first portion of the aperture walls of the second housing member terminal support block aperture.

A second terminating cover has spaced third and fourth leg means extending therefrom with respective third and fourth aperture means adjacent thereto. The third leg means are adapted to be received in the terminal support block aperture of the first housing member from an opposed direction of said first leg means at a pretermination position in an interference fit between a first portion of the third leg means and a second portion of the aperture walls of the first housing member terminal support block aperture. The fourth leg means are adapted to be received in the terminal support block aperture of the second housing member from an opposite direction of the second leg means at a pretermination position in an interference fit between a first portion of the fourth leg means and a second portion of the aperture walls of the second housing member terminal support block aperture.

The first and third leg means are further adapted to be secured in the first housing member terminal support block aperture at a termination position with the first leg means extending into the third aperture means and the third leg means extending into the first aperture means, with the first leg means received in the third aperture means in an interference fit between a second portion of the first leg means and the third walls means.

The second and fourth leg means are further adapted to be secured in the second housing member terminal support block aperture at a termination position with the second leg means extending into the fourth aperture means and the fourth leg means extending into the second aperture means, with the second leg means received in the fourth aperture means in an interference fit between a second portion of the second leg means and the fourth wall means.

DESCRIPTION OF THE PREFERRED EMBODIMENT

Figure 1:
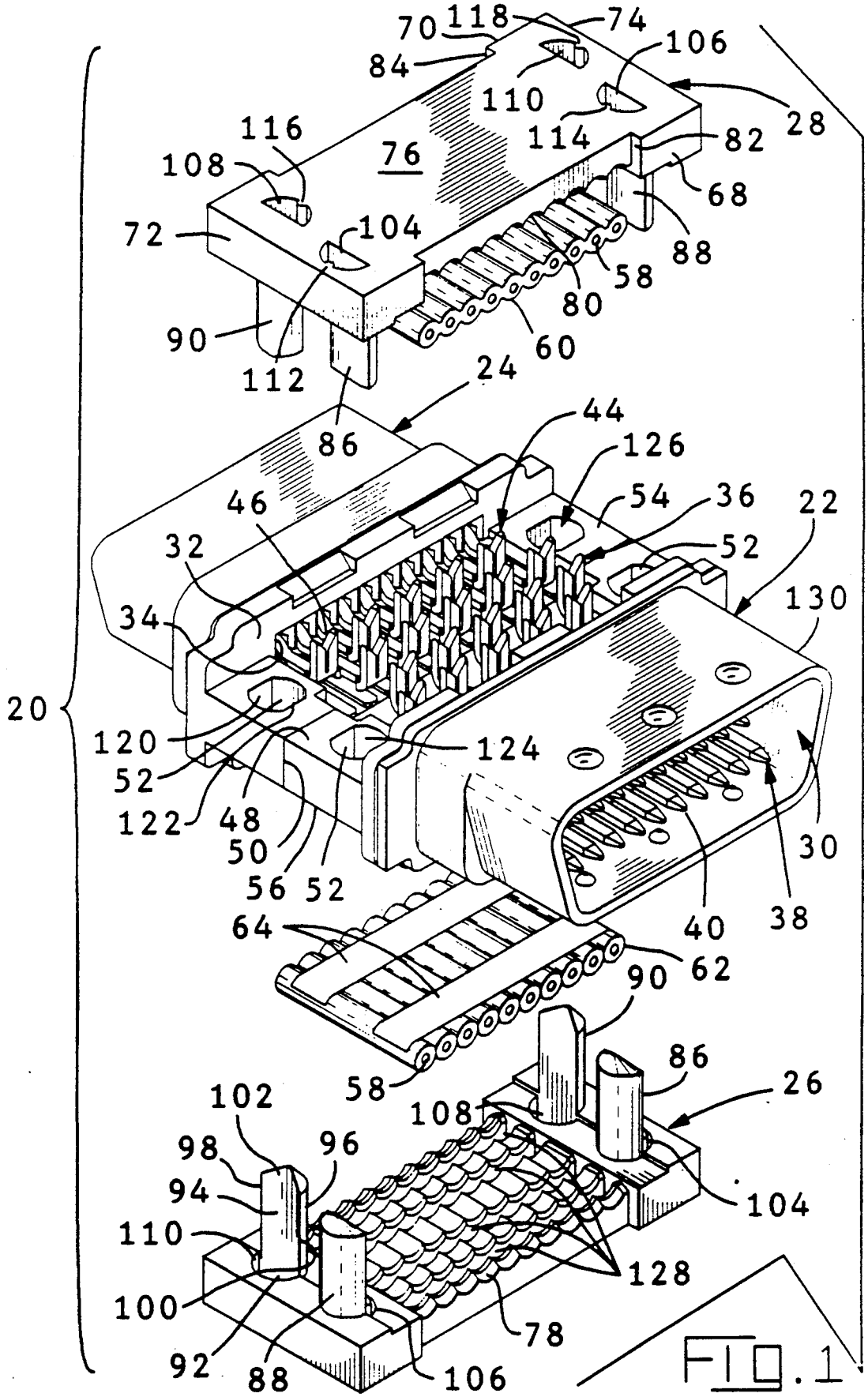
FIG. 1 is an exploded perspective view of a stackable connector in accordance with the present invention.

FIG. 1 shows an exploded perspective view of a stackable connector 20 in accordance with the present invention. Stackable connector 20 is comprised of first and second elongate housings 22,24 molded of thermoplastic material, substantially in accordance with U.S. Pat. No. 4,781,615, the teaching of which is hereby incorporated by reference, and first and second terminating covers 26,28, also molded of thermoplastic material. Housings 22,24 have mating face 30, opposed rear face 32 and a plurality of contact receiving passages 34 extending therebetween. Mating face 30 may provide a polarization feature by having a trapezoidal or subminiature D shape.

In a preferred embodiment, passages 34 are arranged in two rows and have contacts 36 secured therein. Contacts 36 include a mating portion 38 which may be a pin 40 or receptacle 42, extending toward the mating face 30, and a conductor engaging portion 44 extending toward rear face 32. Conductor engaging portion 44 includes a slotted insulation displacement plate 46 extending substantially normal to the axis of contacts 36.

Terminal support block 48 extends rearward from rear face 32 between the two rows of contact receiving passages 34, terminating at rear wall 50. Terminal support block 48 includes apertures 52 at opposite ends thereof. Insulation displacement plates 46 extend upwardly from upper surface 54 of block 48 for the upper row of contacts 36 and downwardly from lower surface 56 of block 48 for the lower row of contacts 36. During termination of conductors in insulation displacing plates 46, the plates 46 bear on respective surfaces 54,56 of block 48. Although housings 22,24 need not be identical, in a preferred embodiment they are identical.

Figure 2:
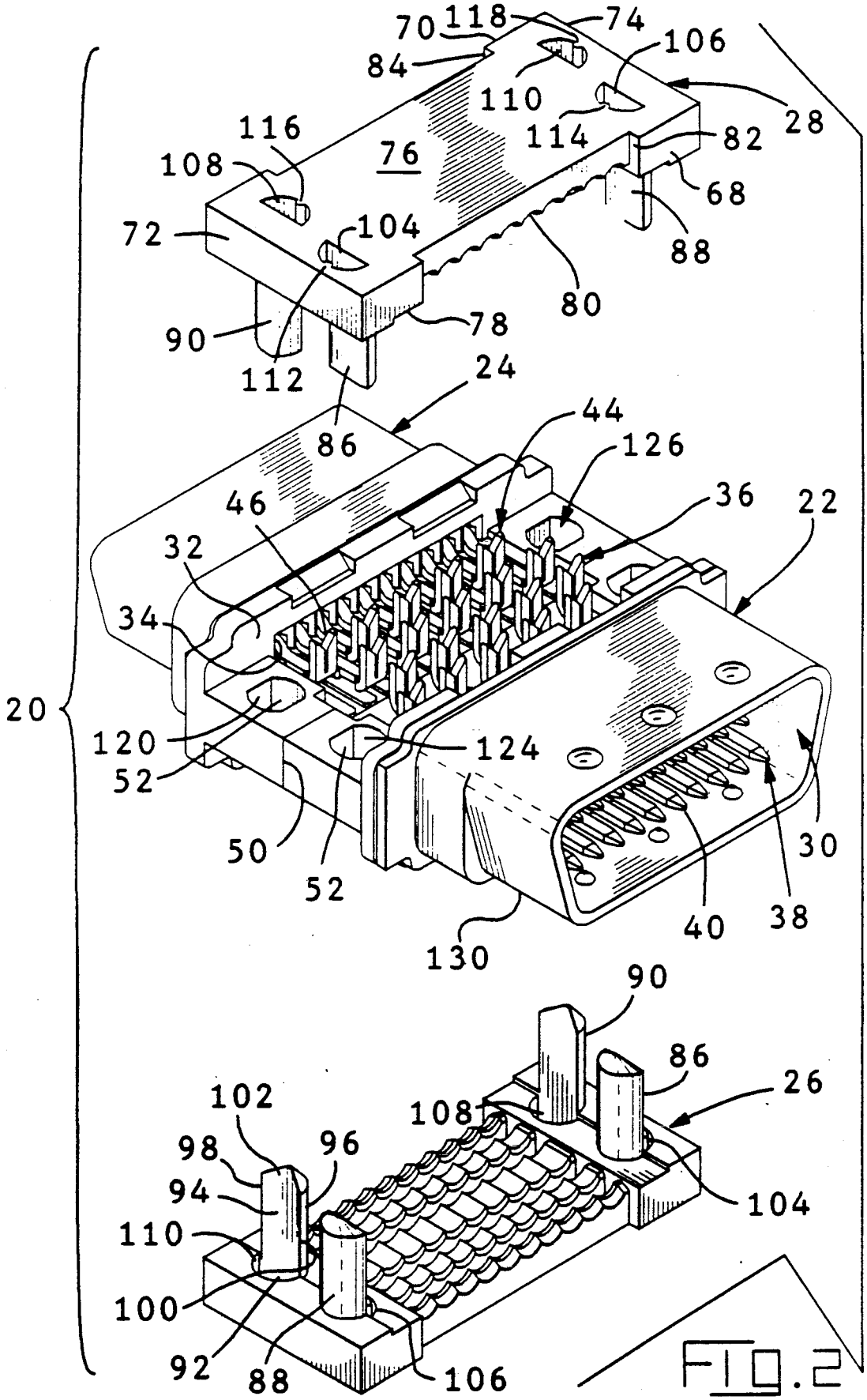
FIG. 2 shows the stackable connector in FIG. 1 with a short segment of cable terminated to interconnect corresponding contacts in the two housing members.
Figure 3:
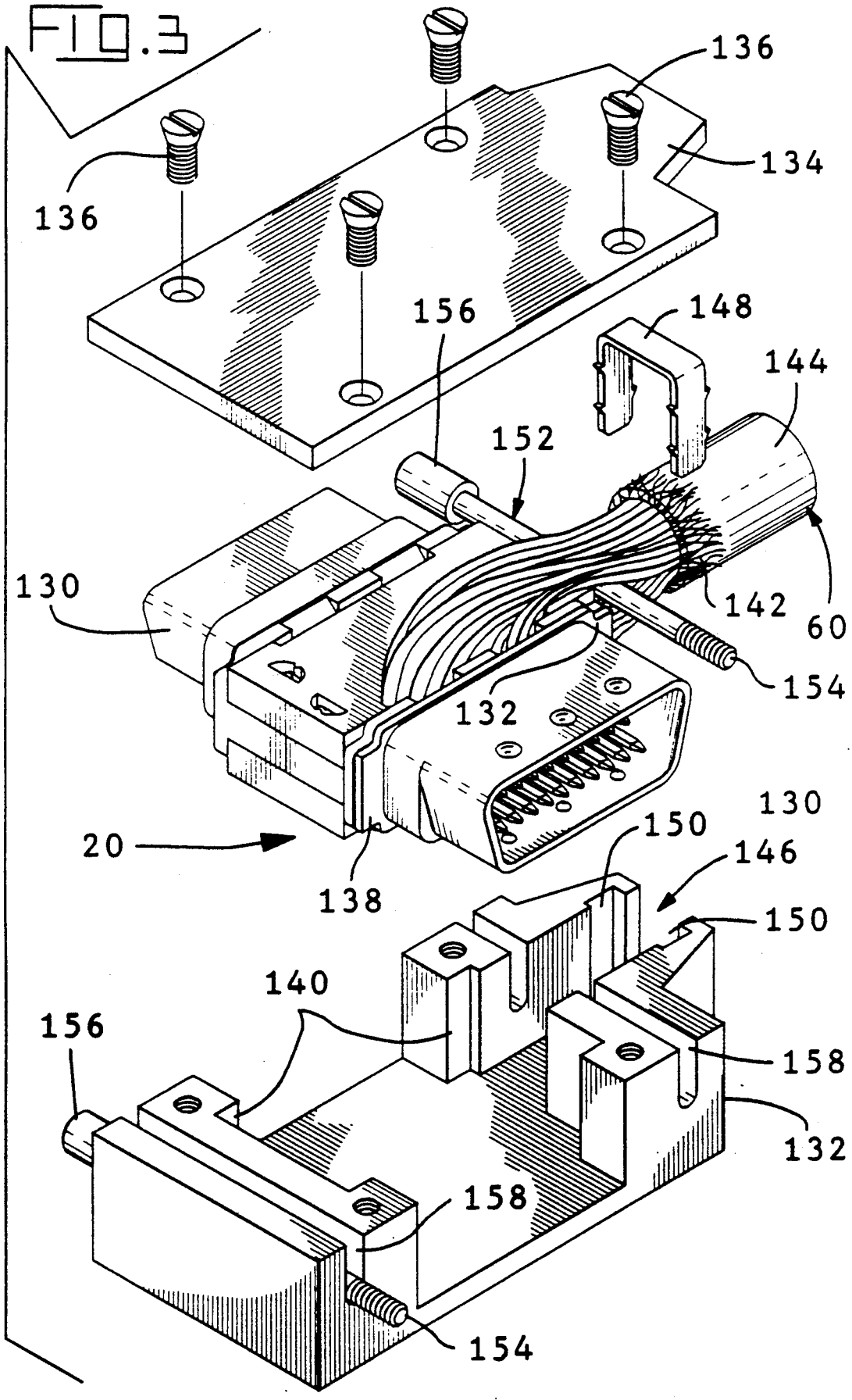
FIG. 3 is a perspective view of a cable terminated to a stackable connector with a back shell and back shell cover exploded therefrom.
Figure 5:
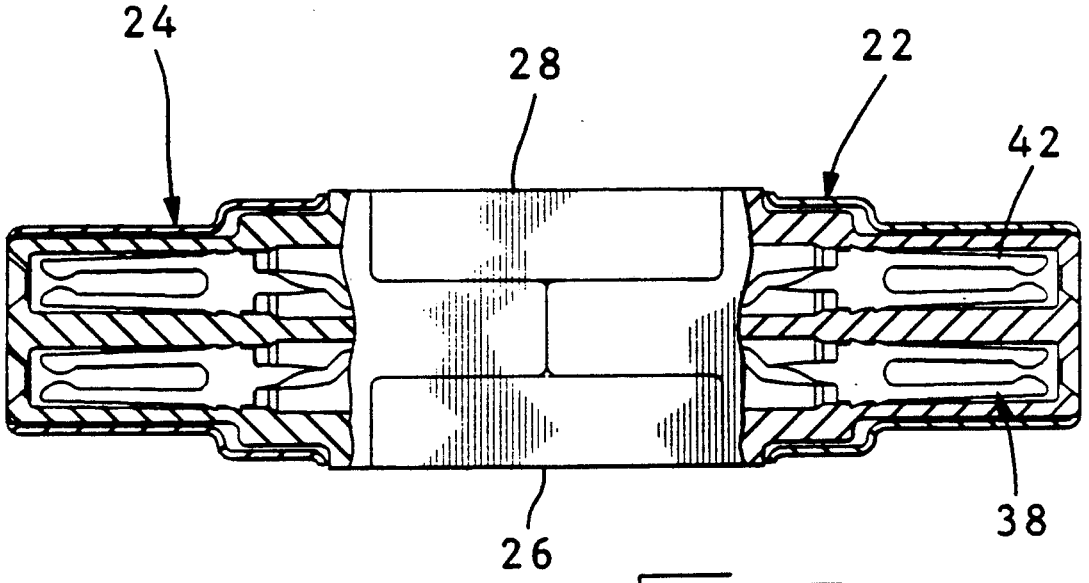
FIG. 5 is a partial cross-section showing, as a stackable connector, back-to-back receptacle connectors.
Figure 6:
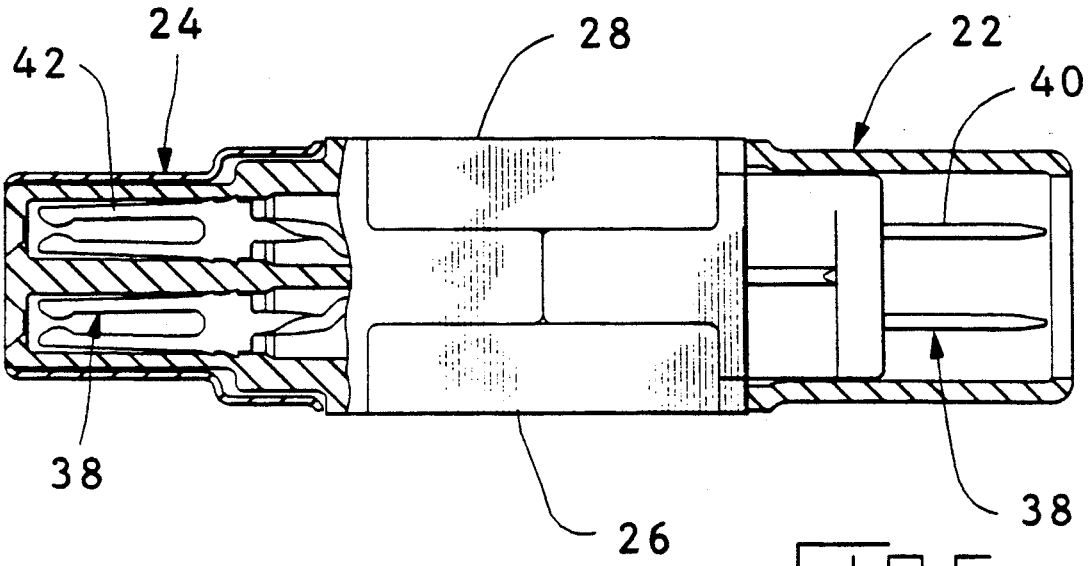
FIG. 6 is a partial cross-section showing, as a stackable connector, pin and receptacle connectors back-to-back.
Figure 7:
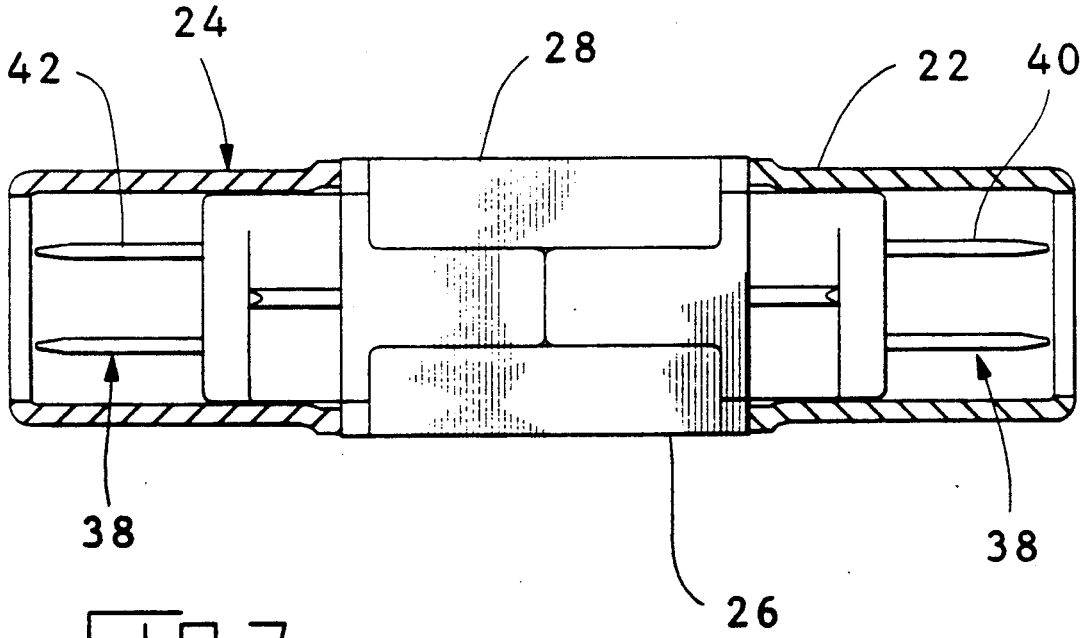
FIG. 7 is a partial cross-section showing, as a stackable connector, back-to-back pin connectors.

A stackable connector, in accordance with the present invention, may terminate conductors 58 of either a ribbon cable 60 or round cable 62, either of which may be shielded or unshielded. FIG. 1 shows a short segment of ribbon cable 60 positioned for termination to the insulation displacement plates 46 on upper surface 54 of terminal support block 48, and a short segment of round cable 62 having conductors 58 maintained in an organized planar configuration by adhesive strips 64 positioned for termination to the insulation displacement plates 46 on lower surface 56 of terminal support block 48. When connector 20 forms the end of a cable assembly, each conductor 58 of a cable is terminated on two corresponding contacts 36, one in housing 22 and the other in housing 24, as shown in FIG. 3. When connector 20 forms a gender changer or extension connector, a short segment of cable 66, either ribbon cable 60 or round cable 62, may be used to interconnect corresponding contacts 36 in housings 22 and 24, as best seen in FIG. 2 with the resulting connector shown in FIGS. 5 through 7.

Terminating covers 26,28 are elongate, having opposed side walls 68,70, opposed end walls 72,74, outer surface 76 and opposed inner surface 78, a portion of which forms fluted surface 80. Terminating covers 26,28 are shown to have a dimension between side walls 68,70 over one half the width of the cable to be placed within connector 20. Side walls 68,70 may have respective recesses 82,84 for passage of conductors 58 of a cable therethrough to egress from beneath terminating covers 26,28. Spaced legs means 86,88,90,92 extend from inner surface 78 proximate end walls 72,74 and side walls 68,70 adjacent corners of covers 26,28. Leg means 86,88 of terminating cover 28 are spaced to be received in apertures 52 in housing 22. Leg means 90,92 of terminating cover 28 are spaced to be received in apertures 52 in housing 24 with housings 22 and 24 positioned with respective rear walls 50 back-to-back, as shown in FIG. 1. Terminating covers 26,28 need not be identical, but are identical in a preferred embodiment. In a further preferred embodiment, terminating covers 26,28 are hermaphroditic.

The cross-section of leg means 86 on terminating cover 28 and leg means 88 on terminating cover 26 complement each other to substantially fill aperture 52 and provide an interference fit with a side wall of aperture 52. Similarly, the pair of leg means received in each aperture 52 complement each other to substantially fill aperture 52 and provide an interference fit with a respective side wall.

In a preferred embodiment, leg means 86,88,90,92 have a cross-section that is a chordal section of a circle, such as a semi-circle, with a flat side 94 and a semi-cylindrical surface 96 defining corners 98,100 at their intersection, and a tapered lead-in end 102.

Adjacent the leg means are respective apertures 104,106,108,110 in at least one of the terminating covers, and when the terminating covers are identical or hermaphroditic, in both terminating covers 26 and 28. Apertures 104,106,108,110 in at least one of the terminating covers 26 or 28, has a protrusion or rib respectively 112,114,116,118 extending thereinto.

Housings 22 and 24 are positioned in a back-to-back relationship with rear walls 50 thereof adjacent each other. Terminating cover 28 is positioned adjacent upper surfaces 54 and terminating cover 26 is positioned adjacent lower surfaces 56 with respective leg means directed toward apertures 52. Terminating covers 26,28 are moved toward housing members 22,24 and toward each other to assemble terminating covers 26,28 to housings 22,24 in a pretermination position. Leg means 86,88,90,92 of terminating cover 28 are received in respective apertures 52 from upper surface 54. In this position, corner 98 of each leg means 86,88,90,92 on terminating cover 28 engages a flat side 120 of aperture 52 in an interference fit and corner 100 engages flat side 122 of aperture 52 in an interference fit. The remaining semi-cylindrical surface 96 slides along arcuate surface 124 of side wall 126. Similarly, leg means 86,88,90,92 of terminating cover 26 are received in respective apertures 52 from lower surface 56, with the corners of the leg means engaging flat sides of the respective aperture in an interference fit.

Terminating covers 26,28 are preassembled to housings 22,24 with fluted surface 80 spaced from insulation displacement plates 46 to receive a planar array of conductors 58 therebetween. Conductors 58 may be a short segment of cable or the end of a cable, as set forth above.

Subsequent to inserting conductors 58 between fluted surface 80 and plates 46, a terminating force is applied to terminating covers 26,28, such as with a press or hand tool, to terminate conductors 58 on the insulation displacement plates 46 of corresponding contacts 36 in housings 22 and 24. This provides an electrical common between corresponding contacts in housings 22 and 24 in a known, one-to-one relationship as is known in the art. Simultaneously, leg means 86,88,90,92 penetrate further into apertures 52. The leading end of leg means 86,88,90,92 on terminating cover 28 enter respectively apertures 104,106,108,110 in terminating cover 26 and the leading end of leg means 86,88,90,92 on terminating cover 26 enter apertures 104,106,108,110 in terminating cover 28.

On terminating cover 28, aperture 104 is adjacent leg means 86 and receives leg means 88 of terminating cover 26 in an interference fit due to said leg means 88 engaging rib 112 which protrudes into aperture 104. Aperture means 106 is adjacent leg means 88 on terminating cover 28 and receives leg means 86 of terminating cover 26 in an interference fit due to said leg means 86 engaging rib 114 which protrudes into said aperture 106. Aperture means 108 is adjacent leg means 90 on terminating cover 28 and receives leg means 92 of terminating cover 26 in an interference fit due to said leg means 92 engaging rib 116 which protrudes into said aperture 108. Aperture means 110 is adjacent leg means 92 on terminating cover 28 and receives leg means 90 of terminating cover 26 in an interference fit due to said leg means 90 engaging rib 118 which protrudes into said aperture 110. The interference fit is achieved by ribs protruding into apertures of terminating cover 28 engaging a surface of leg means on terminating cover 26, such as semi-cylindrical surface 96, that was not previously deformed. Leg means on terminating cover 28 may be similarly received in an interference fit with a rib in an aperture in terminating cover 26.

During application of the termination force, leg means 86,88,90,92 on terminating covers 26,28 cooperate with apertures 52 to maintain proper orientation of terminating covers 26,28 relative to surfaces 54,56 and plates 46, assuring that terminating covers 26,28 move along a path orthogonal to surfaces 54,56. This assures proper insulation displacement termination of conductors 58 as the insulation is pierced perpendicular to the plane of the array of conductors. The free ends of insulation displacement plates 48 are received in recesses 128 in the inner surface 78 of terminating covers 26,28. Shroud 130 may be molded of thermoplastic material or, as shown, be a drawn metallic shell and thereby provide shielding for the mating portion 38 of contacts 36.

Figure 4:
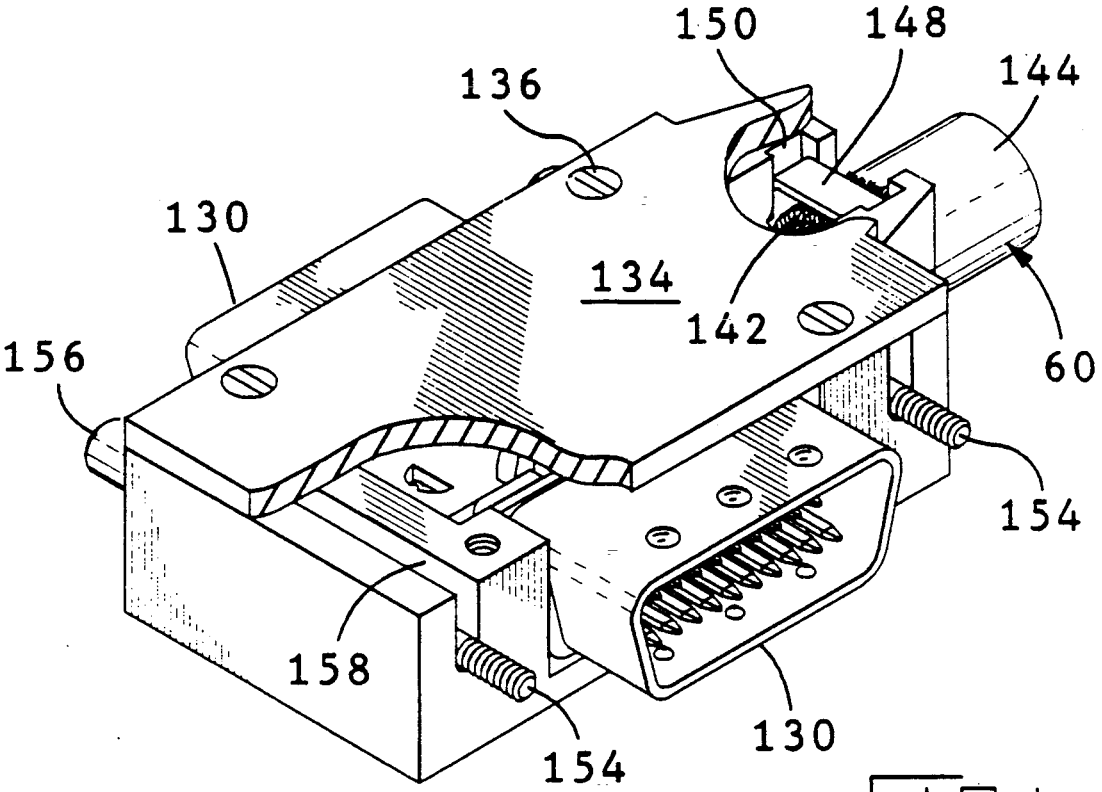
FIG. 4 shows the stackable connector of FIG. 3 received within the back shell and cover.

As shown in FIGS. 3 and 4, stackable connector 20 may be received in an electrically connective back shell 132 and back shell cover 134. The back shell cover 134 is securable in a known manner to back shell 132, such as by screws 136. In applications where shielding is not required, a thermoplastic outer housing may suffice. Flange 138 on shrouds 130 are receivable in recesses 140 of back shell 132 to position stackable connector 20 within back shell 132 and to provide electrical engagement between shroud 130 and back shell 132. Shielding 142 on cable 60 may be folded back over insulative jacket 144, then be received in cable receiving passage 146. Strain relief and electrical continuity with the shielding may be provided in any known manner, such as staple 148 received over shielding 142 and cable 60, and received in channel 150 in accordance with U.S. Pat. No. 4,842,547, the disclosure of which is hereby incorporated by reference. Jack screws 152 having an externally threaded end 154 and an internally threaded head 156 are positioned in jack screw receiving channels 158 to secure back shell 132 to a complementary connector, not shown. The structure of interlocking housings 22,24 and terminating covers 26,28 provide a rigid stackable connector that may be used with or without an outer housing such as back shell 132 and back shell cover 134.

We claim:

1. A stackable connector comprising:

first and second housing members, each of said first and second housing members having a mating face, an opposed rear face and a plurality of contacts extending therebetween in first and second rows, said contacts having a mating portion proximate said mating face and a terminating portion extending beyond said rear face;

a first terminating cover for securing the first and second housing members together and adapted to terminate conductors of a cable to corresponding ones of the contacts in the first row of contacts in the first and second housing members; and a second terminating cover for securing the first and second housing members together and adapted to terminate conductors of a cable to corresponding ones of the contacts in the second row of contacts in the first and second housing members.

2. A stackable connector as recited in claim 1 wherein the first terminating cover further comprises means for engaging the second terminating cover.

3. A stackable connector as recited in claim 1 wherein the second terminating cover further comprises means for engaging the first terminating cover.

4. A stackable connector as recited in claim 1 wherein the first and second housing members are identical.

5. A stackable connector as recited in claim 1 further comprising means for shielding.

6. A stackable connector as recited in claim 1 wherein the first and terminating covers are identical.

7. A stackable connector as recited in claim 6 wherein the first and second terminating covers are hermaphroditic.

8. A stackable connector, comprising:

first and second housing members, each of said first and second housing members having a mating face, an opposed rear face and a plurality of contact receiving passages extending therebetween, with contacts secured therein, said contacts defining an axis, said contacts having a mating portion proximate said mating face, a terminating portion extending beyond said rear face, and extending normal to the axis of said contacts;

a terminal support block extending from the rear face of each of said housing members to respective rear walls, each of said terminal support blocks having a terminal support block aperture therethrough defining aperture walls;

a first terminating cover having extending therefrom spaced first and second leg means having respective first and second aperture means adjacent thereto, said first and second aperture means defining respectively first and second wall means, said first leg means adapted to be received in said terminal support block aperture of said first housing member at a predetermination position in an interference fit between a first portion of said first leg means and a first portion of said aperture walls of said first housing member terminal support block aperture, said second leg means adapted to be received in said terminal support block aperture of said second housing member at a pretermination position in an interference fit between a first portion of said second leg means and a first portion of said aperture walls of said second housing member terminal support block aperture; and a second terminating cover having extending therefrom spaced third and fourth leg means, said third leg means adapted to be received in said terminal support block aperture of said first housing member from an opposed direction from said first leg means at a pretermination position in an interference fit between a first portion of said third leg means and a second portion of said aperture walls of said first housing member terminal support block aperture, said fourth leg means adapted to be received in said terminal support block aperture of said second housing member from an opposed direction from said second leg means at a pretermination position in an interference fit between a first portion of said fourth leg means and a second portion of said aperture walls of said second housing member terminal support block aperture.

9. A stackable connector as recited in claim 8 wherein one of said terminating covers further comprises a recess in a side wall thereof to provide an egress for conductors.

10. A stackable connector as recited in claim 8 wherein a cross-section of the first leg means is a chordal section of a circle.

11. A stackable connector as recited in claim 10 wherein the chordal section is a semi-circle.

12. A stackable connector, comprising:

first and second housing members, each of said first and second housing members having a mating face, an opposed rear face and a plurality of contact receiving passages extending therebetween, with contacts secured therein, said contacts defining an axis, said contacts having a mating portion proximate said mating face, a terminating portion extending beyond said rear face, and extending normal to the axis of said contacts;

a terminal support block extending from the rear face of each of said housing members to respective rear walls, each of said terminal support blocks having a terminal support block aperture therethrough defining aperture walls;

a first terminating cover having extending therefrom spaced first and second leg means having respective first and second aperture means adjacent thereto, said first and second aperture means defining respectively first and second wall means, said first leg means adapted to be received in said terminal support block aperture of said first housing member at a pretermination position in an interference fit between a first portion of said first leg means and a first portion of said aperture walls of said first housing member terminal support block aperture, said second leg means adapted to be received in said terminal support block aperture of said second housing member at a pretermination position in an interference fit between a first portion of said second leg means and a first portion of said aperture walls of said second housing member terminal support block aperture;

a second terminating cover having extending therefrom spaced third and fourth leg means having respective third and fourth aperture means adjacent thereto, said third leg means adapted to be received in said terminal support block aperture of said first housing member from an opposed direction from said first leg means at a pretermination position in an interference fit between a first portion of said third leg means and a second portion of said aperture walls of said first housing member terminal support block aperture, said fourth leg means adapted to be received in said terminal support block aperture of said second housing member from an opposed direction from said second leg means at a pretermination position in an interference fit between a first portion of said fourth leg means and a second portion of said aperture walls of said second housing member terminal support block aperture;

said first and third leg means adapted to be secured in said first housing member terminal support block aperture at a termination position with said first leg means extending into said third aperture means and said third leg means extending into said first aperture means, said first leg means received in said third aperture means in an interference fit between a second portion of said first leg means and said second wall means;

said second and fourth leg means adapted to be secured in said second housing member terminal support block aperture at a termination position with said second leg means extending into said fourth aperture means and said fourth leg means extending said second aperture means, said second leg means received in said fourth aperture means in a interference fit between a second portion of said second leg means and said second wall means, whereby the interference fit that secures the terminating covers in the terminated position is between a wall means and an area of the leg means not previously deformed by the interference fit that retains the terminating covers in the pretermination position.

13. A stackable connector as recited in claim 12 wherein the first and second housing members are identical.

14. A stackable connector as recited in claim 12 wherein the first terminating cover further comprises a rib on said first wall means extending into said first aperture means, whereby the interference fit that secures the second terminating cover in the termination position is an interference fit between a second portion of said third leg means and the rib.

15. A stackable connector as recited in claim 12 further comprising means for shielding.

16. A stackable connector as recited in claim 12 further comprising a cable having conductors, the conductors of said cable terminated to corresponding ones of the contacts in both the first and second housing members.

17. A stackable connector as recited in claim 12 wherein one of said terminating covers further comprises a recess in a side wall thereof to provide an egress for conductors.

18. A stackable connector as recited in claim 12 wherein the first and second terminating covers are identical.

19. A stackable connector as recited in claim 18 wherein the first and second terminating covers are hermaphroditic.

20. A stackable connector as recited in claim 12 wherein a cross-section of the first leg means is a chordal section of a circle.

21. A stackable connector as recited in claim 20 wherein the chordal section is a semi-circle.

22. A stackable connector as recited in claim 12 wherein the mating portion of the contents secured in one of said housing members is a receptacle.

23. A stackable connector as recited in claim 22 wherein the mating portion of the contacts secured in the other of said housing members is a receptacle.

24. A stackable connector as recited in claim 23 wherein the mating portion of the contacts secured in the other of said housing members is a pin.

25. A stackable connector as recited in claim 8, wherein said first and second termination covers are adapted to be secured to said first and second housing members at a termination position with said third leg means extending into said first aperture means and said fourth leg means extending into said second aperture means, said third leg means received in said first aperture means in an interference fit between a second portion of said third leg means and said second wall means and said fourth leg means received in said second aperture means in an interference fit between a second portion of said fourth leg means and said second wall means, whereby the interference fit that secures the terminating covers in the terminated position is between a wall means and an area of the leg means not previously deformed by the interference fit that retains the terminating covers in the pretermination position.

26. A stackable connector as recited in claim 25 wherein the first terminating cover further comprises a rib on said first wall means extending into said first aperture means, whereby the interference fit that secures the second terminating cover in the termination position is an interference fit between a second portion of said third leg means and the rib.

27. A stackable connector as recited in claim 25 further comprising a cable having conductors, the conductors of said cable terminated to corresponding ones of the contacts in both the first and second housing members.

28. A stackable connector, comprising:

first and second housing members, each of said first and second housing members having a mating face and an opposed rear face, with a plurality of contact receiving passages disposed therebetween having contacts secured therein, said contacts defining an axis, said contacts having a mating portion proximate said mating face, and a terminating portion extending beyond said rear face, said terminating portion extending normal to the axis of said contacts;

a terminal support block extending from the rear face of each of said housing members, each said terminal support block having a pair of spaced apertures therethrough normal to the axis of said contacts, said apertures defining aperture walls;

a first terminating cover having extending normally thereof spaced first leg means and spaced second leg means, said first and second leg means having respective first and second aperture means adjacent thereto, said first and second aperture means defining respectively first and second wall means, said first leg means adapted to be received in said pair of apertures of said first housing member at a pretermination position with at least one of said first leg means in an interference fit between a first portion of said at least one first leg means and a first portion of said aperture walls of a respective one of said pair of apertures of said first housing member, said second leg means adapted to be received in said first of apertures of said second housing member at a pretermination position with at least one of said second leg means in an interference fit between a first portion of said at least one second leg means and a first portion of said aperture walls of a respective one of said pair of apertures of said second housing member; and a second terminating cover having spaced third leg means and spaced fourth leg means extending normally thereof, said third leg means adapted to be received in said pair of apertures of said first housing member from an opposed direction from said first leg means, said fourth leg means adapted to be received in said pair of apertures of said second housing members from an opposed direction from said second leg means, said third leg means adapted to be received in said pair of apertures of said first housing member at a pretermination position with at least one of said third leg means in an interference fit between a first portion of said at least one third leg means and a second portion of said aperture walls of a respective one of said pair of apertures of said first housing member, said fourth leg means adapted to be received in said pair of apertures of said second housing member at a pretermination position with at least one of said fourth leg means in an interference fit between a first portion of said at least one fourth leg means and a second portion of said aperture walls of a respective one of said pair of apertures of said second housing member.

29. A stackable connector as recited in claim 27, wherein said third leg means are adapted to be secured in said apertures of said first housing member at a termination position with at least one of said third leg means extending into a respective one of said first aperture means in an interference fit between a second portion of said third leg means and respective first wall means, said fourth leg means are adapted to be secured in said pair of apertures of said second housing member at a termination position with at least one of said fourth leg means extending into a respective one of said second aperture means in an interference fit between a second portion of said fourth leg means and respective second wall means.

* * * * *